US009197951B1

(12) United States Patent
Yang et al.

(10) Patent No.: US 9,197,951 B1
(45) Date of Patent: Nov. 24, 2015

(54) LEVITATED STRUCTURE OF BLUETOOTH SPEAKER

(71) Applicant: ASWY ELECTRONICS CO., LTD., New Taipei (TW)

(72) Inventors: He Chen Yang, New Taipei (TW); Po Le Wang, New Taipei (TW)

(73) Assignee: ASWY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 14/617,080

(22) Filed: Feb. 9, 2015

(30) Foreign Application Priority Data

May 16, 2014 (TW) ..... 103208662 U

(51) Int. Cl.
*H04R 1/02* (2006.01)
*H04R 9/06* (2006.01)

(52) U.S. Cl.
CPC ..... *H04R 1/02* (2013.01); *H04R 1/028* (2013.01); *H04R 9/06* (2013.01); *H04R 2420/07* (2013.01); *H04R 2499/11* (2013.01)

(58) Field of Classification Search
CPC ..... H04R 1/02; H04R 1/025; H04R 1/028; H04R 9/025; H04R 9/06; H04R 9/10; H04R 2400/13; H04R 2420/07; H04R 2499/11; H04R 2499/15
USPC ..... 381/304, 305, 332, 334, 335, 386, 388, 381/189, 394, 395, 396; 379/433.02, 438, 379/443; 320/107, 108
See application file for complete search history.

(56) References Cited

U.S. PATENT DOCUMENTS 8,406,449 B2 * 3/2013 Wegener ..... H04R 1/02 381/386
2012/0294473 A1 * 11/2012 Pierce ..... H04R 9/06 381/396
2014/0321686 A1 * 10/2014 Wegener ..... H04R 1/028 381/332

* cited by examiner

*Primary Examiner* — Huyen D Le
(74) *Attorney, Agent, or Firm* — Rabin & Berdo, P.C.

(57) ABSTRACT

A levitated structure of Bluetooth speaker, which is composed of a main frame, a control circuit module, an induced coil module, a speaker, a circular frame and a top frame, which enables the main frame to be levitated over the base, and carry out wireless sensing and transmission of the AC (Alternating Current) signal with electric energy to play external audio signal received by the Bluetooth signal receiver, and provide a better power solution free from the shortage of electric power and also extend the performance period of speaker function.

10 Claims, 8 Drawing Sheets

LEVITATED STRUCTURE OF BLUETOOTH SPEAKER

BACKGROUND OF THE INVENTION

1. Field of the Invention

The present invention relates to a levitated structure of Bluetooth speaker, which is specifically referred to a joint structure of induced reception coil configured within the induced coil module to carry out wireless sensing and then transmit the AC (Alternating Current) signal with electric energy, and the said signal is finally transformed into the format of electric energy via a signal to energy converter to provide a practical and extensional power solution applied in a structure of wireless Bluetooth speaker or similar devices.

2. Description of Prior Art

The present speaker structure is usually configured on the table or ground to connect with the main control machine or player via an audio signal cord which transformed the signal into a louder audio output.

Under such a connecting configuration, the audio environment is full of signal or audio cord on the ground/wall, which leads to an inconvenience for the listeners who have to pay more attention from stumble or fouled situation with those audio cords. It is even worse, if there is any damage to the audio machine or equipment.

And, the said audio machine or speaker needs power to be activated or start the play function. Therefore, not only the signal cord but also the power cord limits the space of audio environment. Thought, reserved power (battery) had been adopted for the operation of speaker to provide a better audio space. However, it caused the extra issue of battery replacement for speaker device. And, it results a short-coming to process those reserved power (battery) which are out of function or discarded. Above all, changing the reserved power means there must be an interruption during the function of speaker. The problem for prior speaker structure is still not solved.

In view of the above discussed problems, the present invention aims to provide a levitated structure of Bluetooth speaker to have a levitation function and adequate power supply without interruption, and a better audio space. Therefore, the prior speaker structure needs to be improved.

SUMMARY OF THE INVENTION

The primary object of the present invention is to provide a levitated structure of Bluetooth speaker, which is composed of a main frame, a control circuit module, an induced coil module, a speaker, a circular frame and a top frame, which enables a joint structure of induced reception coil configured within the induced coil module to carry out wireless sensing and then transmit the AC (Alternating Current) signal with electric energy, and the said signal is finally transformed into the format of electric energy via a signal to energy converter to supply the power consumption of circuit board configured on the control circuit module. Besides, the bottom position of the main frame is configured with a magnetic element to be levitated over the base which is also configured with a magnetic element of reverse polarity. And, the external audio signal received by the Bluetooth signal receiver of the control circuit module is played from the speaker inside the main frame. Thus, the present invention provides a practical and extensional power solution applied in a structure of wireless Bluetooth speaker or similar devices.

Another object of the present invention is to provide a levitated structure of Bluetooth speaker, wherein both the main frame and the base are configured with a magnetic element of reverse polarity to enable the main frame to be levitated over the base, and there are energy to signal converter and induced transmission coil are configured inside the base to transform electric energy into alternating current signal via energy to signal converter and then is transmitted by the induced transmission coil. Therefore, the present invention provides a function and effect of energy wireless transmission.

In short, the present invention comprises a main frame, a control circuit module, an induced coil module, a speaker, a circular frame and a top frame, wherein the main frame, accommodated with a control circuit module, is concaved with an inner space, and a magnetic element is configured at the bottom position. The control circuit module is further comprising a circuit board, a control panel, a signal to energy converter and a Bluetooth signal receiver, wherein the control panel, the signal to energy converter and the Bluetooth signal receiver are electronically linked with the circuit board, and the Bluetooth signal receiver receives external audio signal by wireless and controls power on/off and audio volume via the operation of control panel. The induced coil module, configured at the bottom position main frame, is further configured with an induced reception coil and a transmission cord. Meanwhile, one end of the transmission cord is electronically linked with the induced reception coil which has the most inner coil wrapping around the external of magnetic element configured inside the main frame. And, the other end of transmission cord is electronically linked with the signal to energy converter of control circuit module, and carries out wireless sensing and transmits alternating current signal with energy via induced reception coil into signal to energy converter. The alternating current signal with energy is finally supplied for circuit board power consumption of control circuit module. The speaker is electronically linked with and is configured over the circuit board of control circuit module. The circular frame is configured with control keys which are corresponding to the control panel of control circuit module. And, the top frame is configured and located at the upper position of circular frame.

The function and structure of practical embodiments can be further understood via the following brief description of the drawings and elements listed below.

BRIEF DESCRIPTION OF THE DRAWINGS AND ELEMENTS

The present invention can be fully understood from the following detailed description and preferred embodiment with reference to the accompanying drawings, in which.

DETAILED DESCRIPTION OF THE PREFERRED EMBODIMENTS

Figure 1:
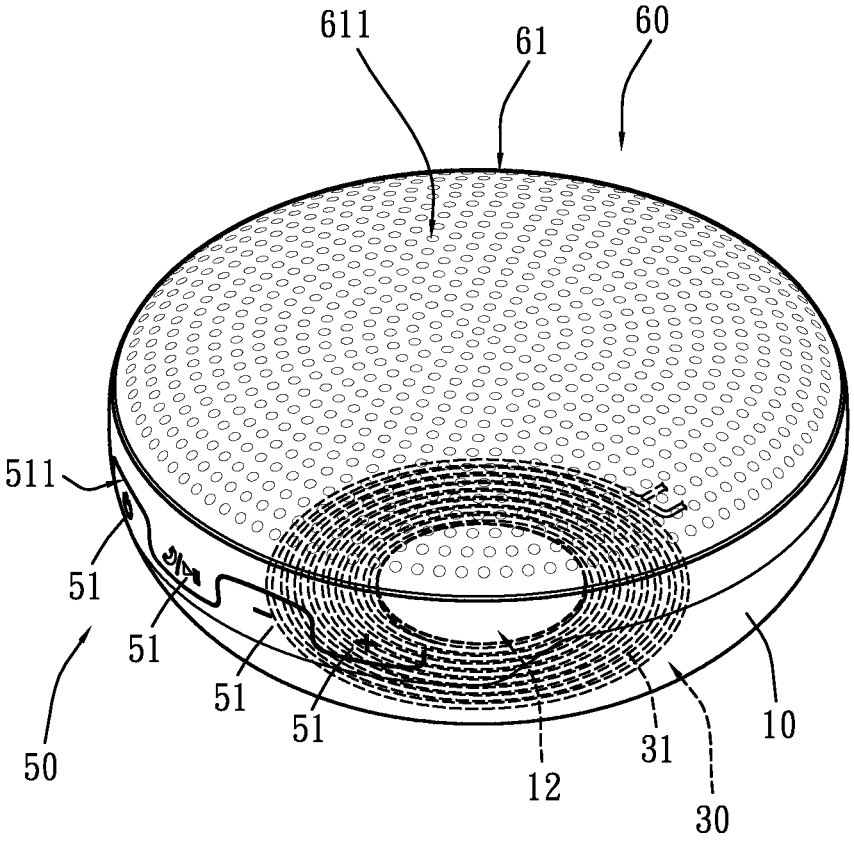
FIG. 1 illustrates a three-dimensional appearance of the present invention.
Figure 2:
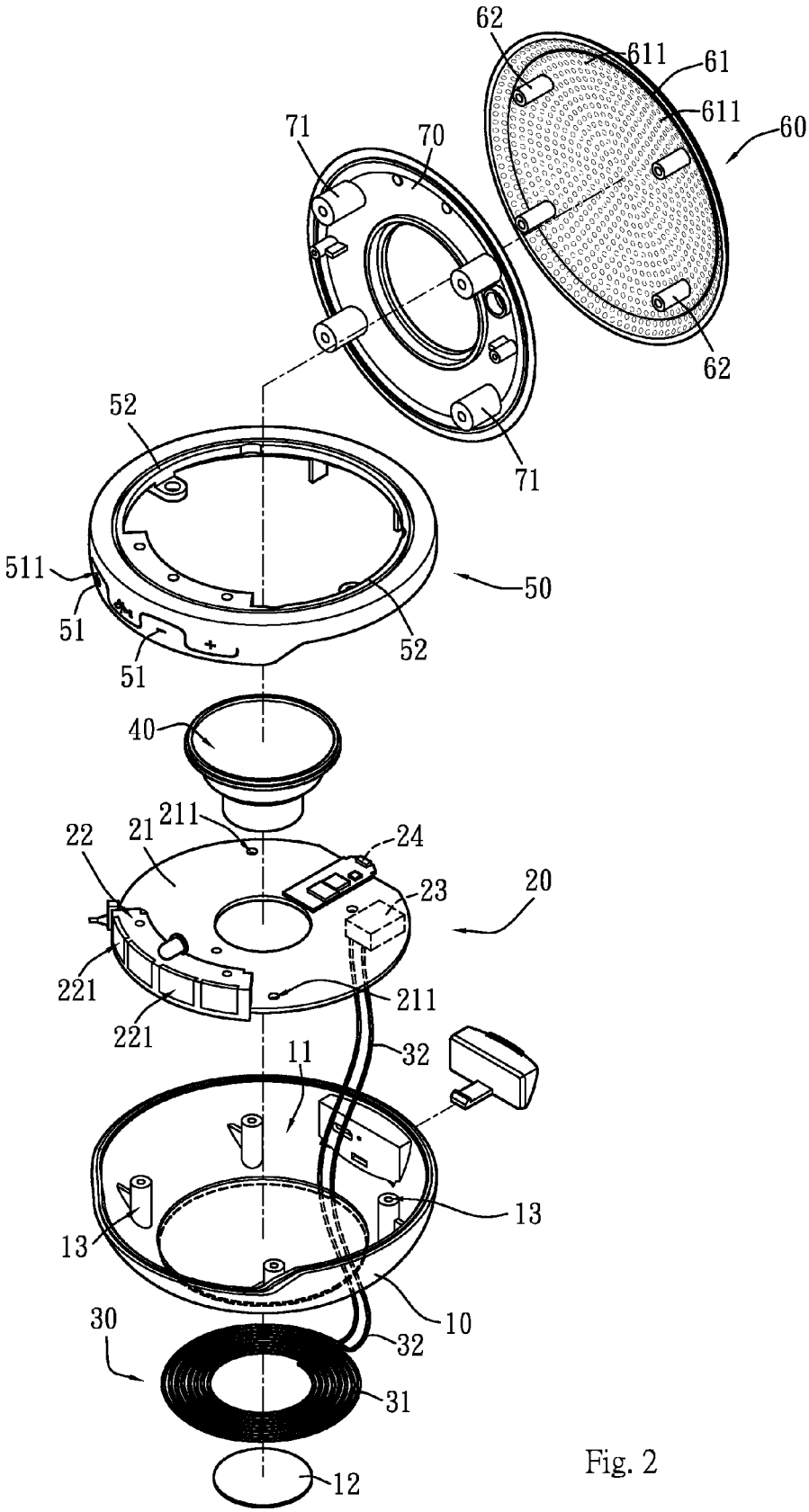
FIG. 2 illustrates a schematic element decomposition view of the present invention.

Please refer to FIG. 1 to FIG. 8 which respectively illustrates those schematic views referring to a levitated structure of Bluetooth speaker, wherein the best embodiment is applied in a speaker structures with Bluetooth function, and is primarily comprising a main frame 10, a control circuit module 20, an induced coil module 30, a speaker 40, a circular frame 50, and a top frame 60 (as shown in FIG. 2). The main frame 10 is concaved to form an inner space 11 and is configured with certain area at the inner bottom to accommodate a magnetic element 12 which could be chosen from any one of permanent magnet (ferroxdure), electronic magnet or rare-earth magnet, etc. to be characterized with a stronger magnetism than the ordinary one and is free from demagnetization, and is suitable to be adopted as a magnetic element 12 to repel the other one with a reverse polarity.

And, the control circuit module 20 is configured inside the inner space 11 of main frame 10, and is further comprising a circuit board 21, a control panel 22, a signal to energy converter 23 and Bluetooth signal receiver 24 (as shown in FIG. 2), wherein the said control panel 22, signal to energy converter 23 and Bluetooth signal receiver 24 are electronically linked with the circuit board 21 respectively. The signal to energy converter 23, configured with a transformer element (Fig. not shown), executes the function to transform the alternating current (AC) signal coupled with energy characteristic into another format of direct current (DC) electric power.

Figure 4:
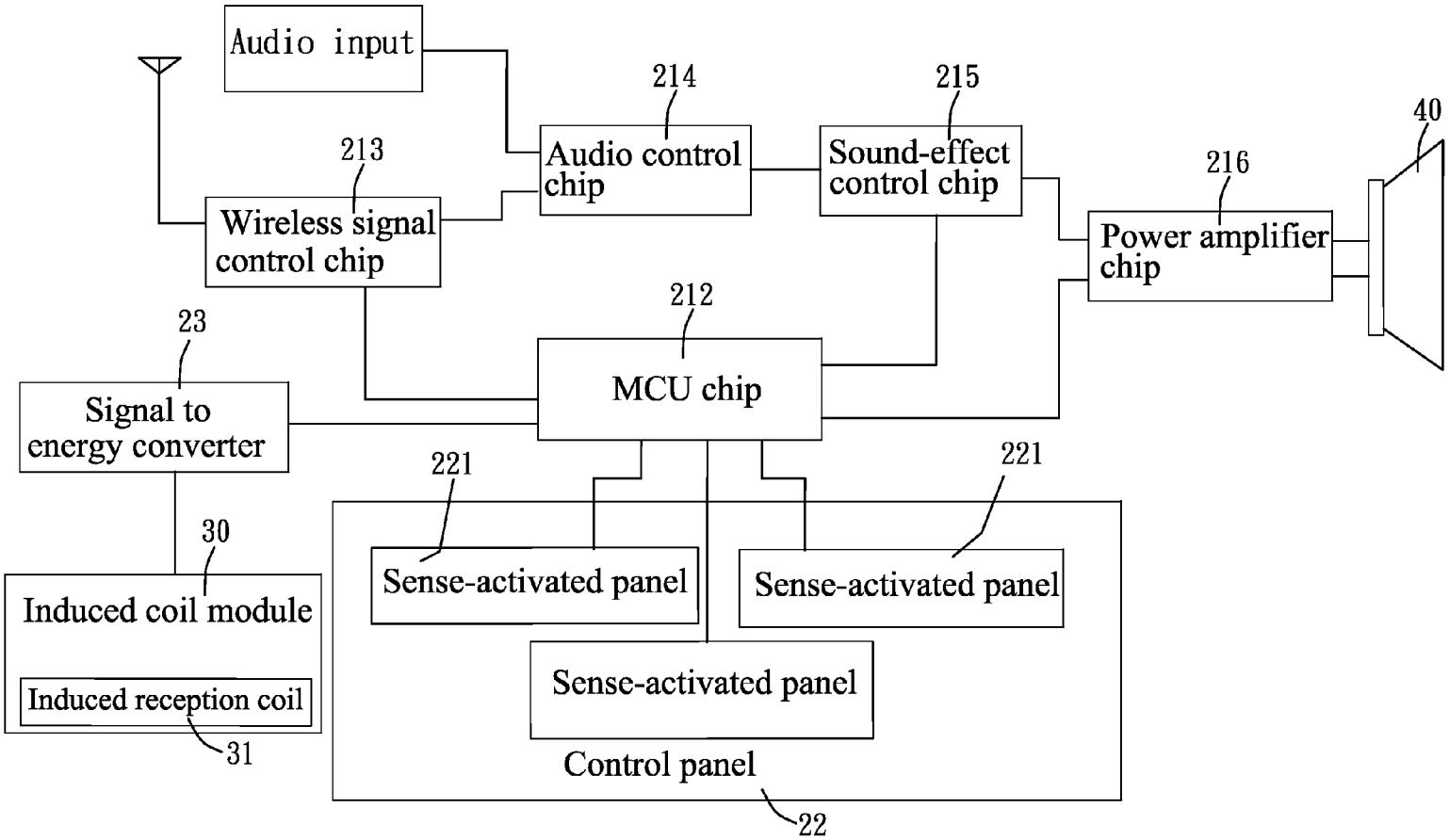
FIG. 4 illustrates a schematic circuit block diagram of the present invention.

The above-mentioned circuit board 21 is configured with a micro control unit (MCU) chip 212 to control the input and output of audio signal. Besides, it is further configured with a wireless signal control chip 213, audio control chip 214, sound-effect control chip 215, power amplifier chip 216, capacitors and resistors electronic parts, etc. (as shown in FIG. 4) to form as a control circuit of audio output and input. Meanwhile, the circuit board 21 is configured with a control panel 22 composed of sense-activated panel 221 to control any or at least two combined operation of volume, power on/off, signal on/off from portable audio devices, audio pause and/or start, etc. to enable the control panel 22 with a variety of operation.

Besides, the circuit board 21 is electronically linked with a Bluetooth signal receiver 24 to receive external audio signal wirelessly, wherein the external audio signal comes from any or at least two devices with Bluetooth function such as a media player, portable devices, DVD stereo, TV and/or vehicle GPS guidance media system.

The induced coil module 30, configured inside the bottom of main frame 10, is further assembled with an induced reception coil 31 and a transmission cord 32 (as shown in FIG. 2), wherein the transmission cord 32 has one end electronically connected with the induced reception coil 31 which wraps around the magnetic element 12 of main frame 10 with its inner most coil. And, the said assembly structure of induced reception coil 31 will not overlapped with the magnetic element 12 and free from any mutual interference. Meanwhile, the other end of transmission cord 32 is linked with signal to energy converter 23 of the control circuit module 20 to have wireless sensing and transmit AC energy signal consequently. The transmitted AC energy signal inside the signal to energy converter 23 is finally transformed into DC energy format to provide power consumption of circuit board 21 configured onboard control circuit module 20 and power consumption of chips and electronic parts connect with each other.

The circuit board 21 of control circuit module 20 is configured with a speaker 40 linked with circuit board 21 whose middle position is formed as a empty circle space to accommodate one end of the speaker 40 which is composed of electric magnet, coil and vibrating membrane, and have one end with vibrating membrane facing upward. The speaker 40 has its audio operation when the current flows through the coil and that pushes the vibration of membrane which is classified as different types such as conic, planar and/or bulbous.

Yet, the upper position of main frame 10 is configured with a circular frame 50, which has a hollow space in the middle and is further assembled with control keys 51 (as shown in FIG. 1). The control keys 51 could be formed as a planar touch control panel 511, which shows the icon to operate volume, power on/off, signal on/off from portable audio devices, audio pause and/or start, etc. to enable the control panel 22 with a variety of operation. The control keys 51 are mechanically corresponding to the control panel 22 of control circuit module 20, which enables sense-activated panel 221 following the operation from control keys 51 and passing the operation instruction to MCU chip 212 to execute related function.

Figure 3:
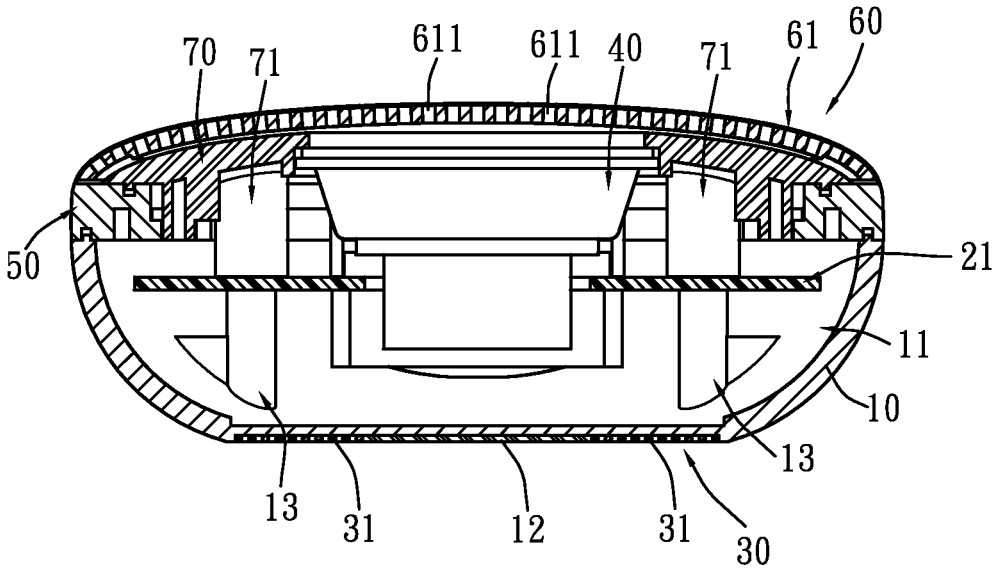
FIG. 3 illustrates a schematic section view of the present invention.

Furthermore, the upper of circular frame 50 is configured with a top frame 60 which is assembled with a net cover 61. The said net cover 61 is penetrated with plural of net holes 611 to transmit outward the sound from speaker 40. And, there is a fixing plate 70 configured between the circular frame 50 and the top frame 60 (as shown in FIGS. 2 and 3). The fixing plate 70 is formed as a hollow shape in the middle position to accommodate speaker 40 and penetrate through both center of circular frame 50 and fixing plate 70, and the outer rim of speaker's membrane is stopped by and corresponding to the center of fixing plate 70, and is facing forward and aligned with the net cover 61 to provide audio wave having an access to external environment. And, the inner rim of circular frame 50 is extended with a round structure of rib ring 52 (as shown in FIG. 2) which is embedded into and fits with the circumference of fixing plate 70. The inner side of fixing plate 70 is configured with plural upper screw posts 71 and the inner side of top frame 60 is also configured with corresponding fitting posts 62 which matches and are inserted into the plural upper screw posts 71 to provide an easy assembly with fixing plate 70.

Last, the main frame 10 is extended with plural lower screw posts 13 which are corresponding designed with the screw holes 211 configured on the circuit board 21. When fixing plate is assembled with the inner side of rib ring 52, the length and position of upper screw posts 71 matches screw holes 211 on the circuit board 21 (as shown in FIG. 3) and thus enables a complete and stable structure assembly of upper screw posts 71, through screw holes 211, and plural lower screw posts 13 via screw parts (not shown).

Figure 5:
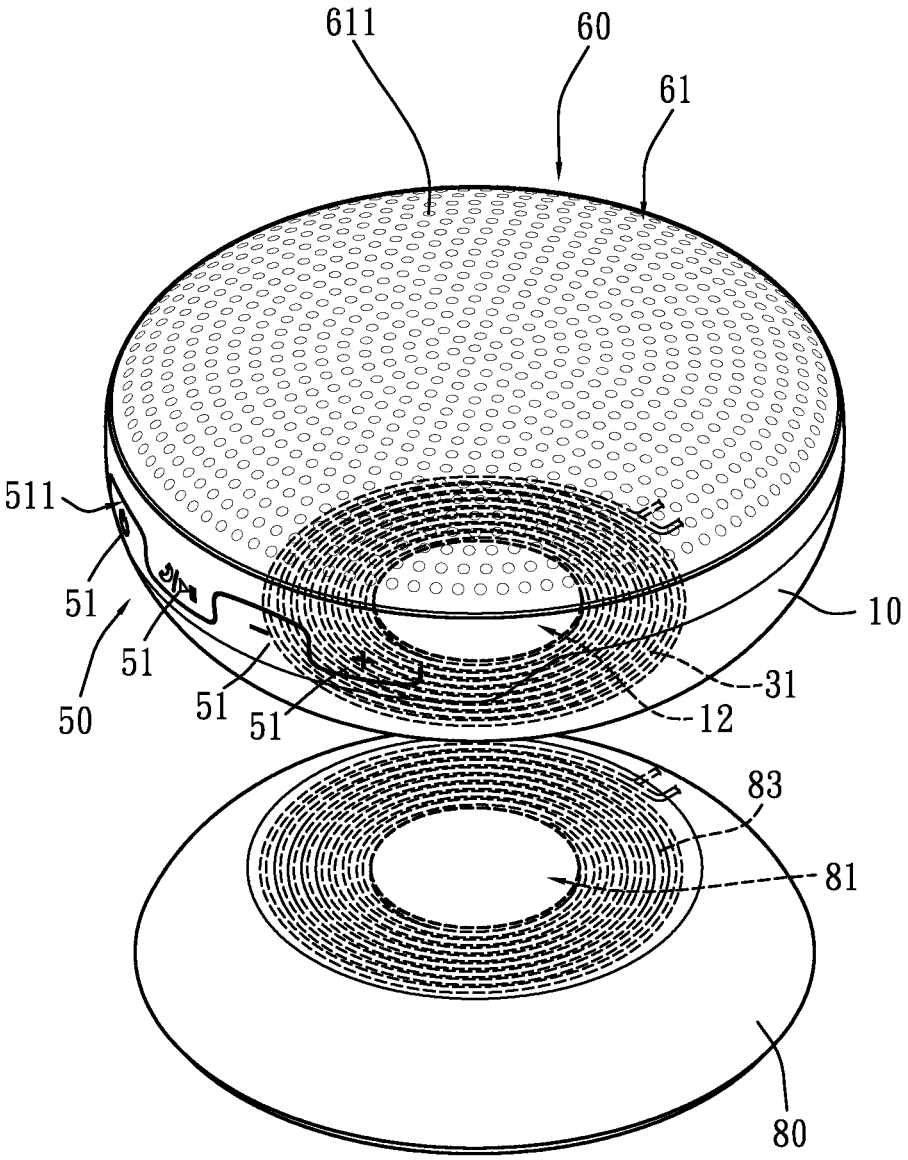
FIG. 5 illustrates a schematic view of the embodiment levitated over the base of the present invention.
Figure 6:
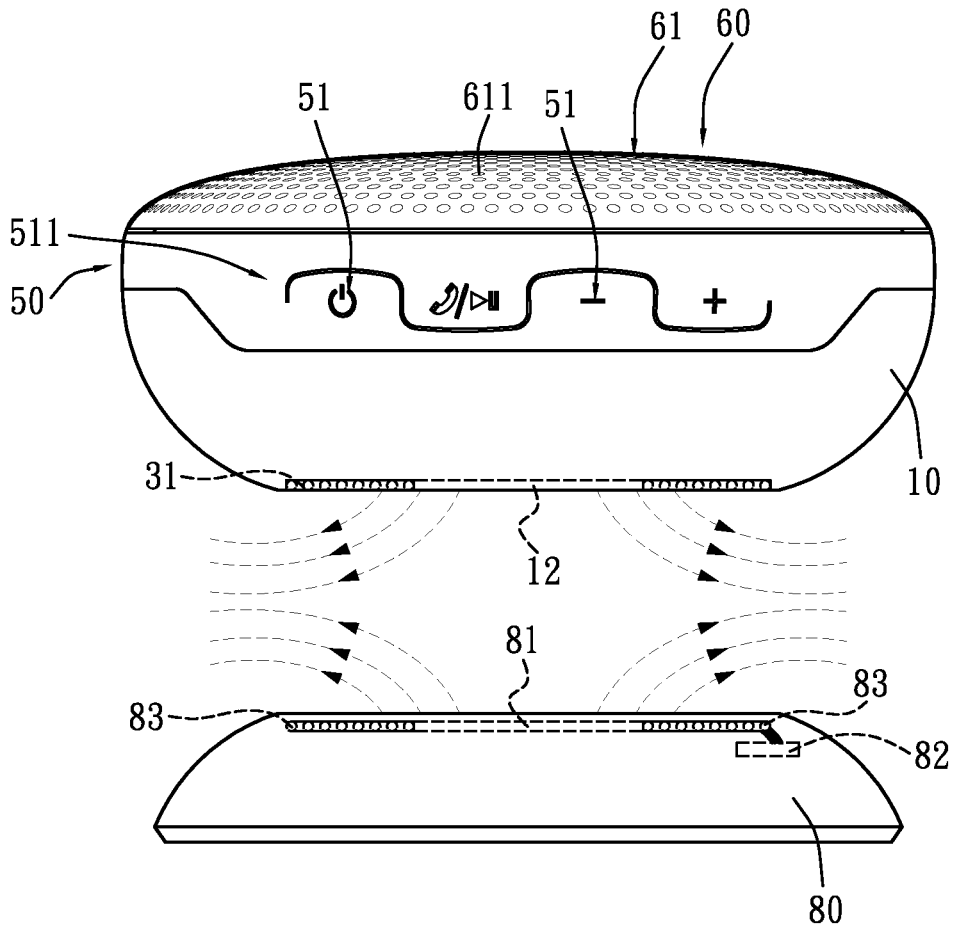
FIG. 6 illustrates a schematic view and action of the embodiment with both magnetic elements opposed by the reverse polarity.

Yet, the working status of the present means that the main frame 10 is able to be levitated over the base 80 which is configured with a magnetic element 81 at inner top position (as shown in FIG. 5). The magnetic element 81 could be chosen from any one of permanent magnet (ferroxdure), electronic magnet or rare-earth magnet, etc. to be characterized with a stronger magnetism than the ordinary one and is free from demagnetization, and is suitable to be adopted as a magnetic element 81 to repel the other one (magnetic element 12 inside the main frame 10) with a reverse polarity which enables main frame 10 to be levitated over the base 80.

And, there is an energy to signal converter 82 and an induced transmission coil 83 configured inside the base 80, wherein the energy to signal converter 82 and the induced transmission coil 83 are electronically connected with each other and the inner most coil of induced transmission coil 83 wraps around the outer rim of magnetic element 81 to avoid mutual overlapping and leads to interference. The said energy to signal converter 82 transforms the energy into AC signal and transmits it to induced reception coil 31 on the induced coil module 30 located at main frame 10 to carry out wireless transmission.

Figure 7:
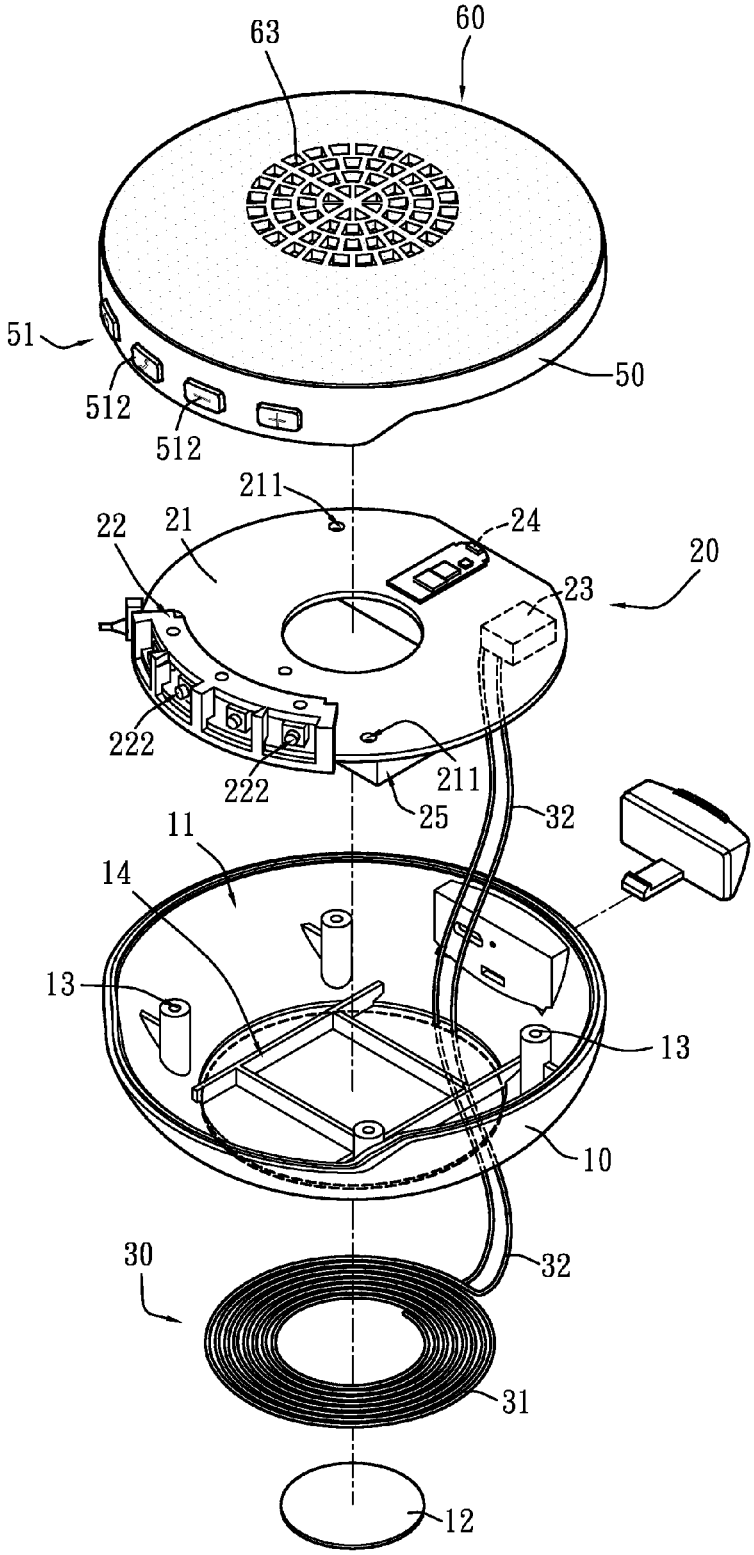
FIG. 7 illustrates a schematic element decomposition view of another embodiment of the present invention.
Figure 8:
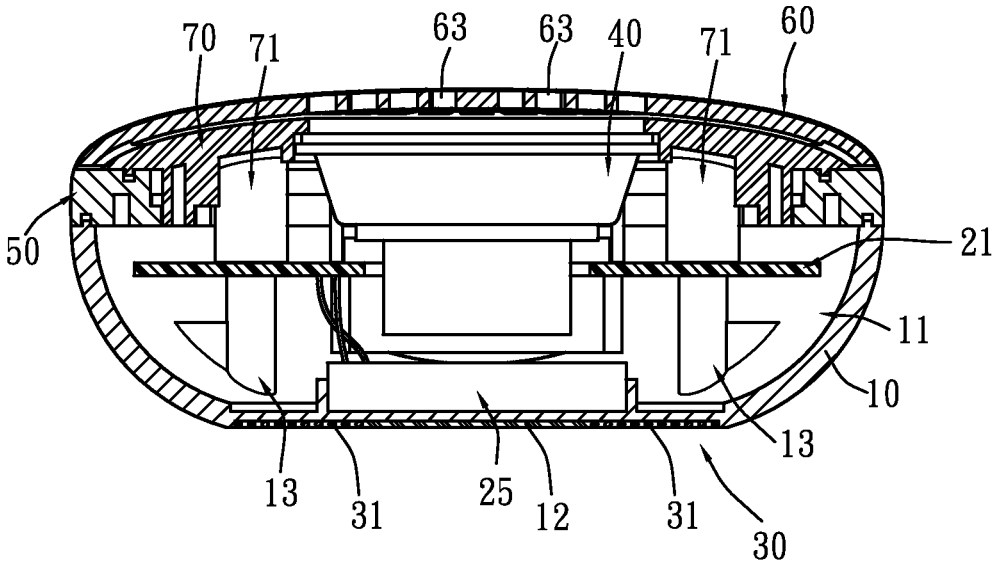
FIG. 8 illustrates a schematic section view of another embodiment of the present invention.

Another embodiment of the present invention is characterized that the circuit board 21 of control circuit module 20 is electronically connected with a rechargeable battery 25 (as shown in FIG. 7) which is further electronically connected with the signal to energy converter 23 to save the transformed output DC energy and use as a power consumed by circuit board 21 and other chips and/or electronic parts. When the control circuit module 20 is configured inside the inner space 11 of main frame 10, wherein the lower position is extended with a battery rack 14 which tightly fits with rechargeable battery 25 (as shown in FIG. 8) to provide a good positioning function and an easy assembly of the present invention.

The control keys 51 of circular frame 50 at the upper position of main frame 10 could adopt a push button 512 design (as shown in FIG. 7) and the control panel 22 is correspondingly configured with plural operation control switches 222 matching with those push buttons 512 to carry out control of any or at least two combined operation as volume, power on/off, signal on/off from portable audio devices, audio pause and/or start, etc. to enable the operation control switches 222 have connection with MCU chip 212 to carry out a variety of operation according to those command it receives.

And, the top frame 60 over circular frame 50 is configured with plural top holes to have an access for audio wave output to external environment. Also, there is a fixing plate 70 configured between the circular frame 50 and the top frame 60. The fixing plate 70 is formed as a hollow shape in the center position to accommodate speaker 40 and penetrate through both center of circular frame 50 and fixing plate 70, and the outer rim of speaker's membrane is stopped by and corresponding to the center of fixing plate 70, and is facing upward and aligned with the net holes 63 (as shown in FIG. 8) to provide audio wave having an access to external environment.

From the above detailed description, the present invention provides a disclosure and it enables the person skilled in this field is able to understand and complete the skill characteristic.

Of course, it is to be understood that the embodiments described herein are merely some illustrations related to the objects of the invention and that a wide variety of modifications thereto may be adopted without departing from the purpose and the scope of the present invention as set forth in the following claims.

The elements related to the present invention are listed as follows:

| | | | |
|---|---|---|---|
| 10 | main frame | 11 | inner space |
| 12 | magnetic element | 13 | lower screw post |
| 14 | battery rack | 20 | control circuit module |
| 21 | circuit board | 22 | control panel |
| 23 | signal to energy converter | 24 | blue tooth signal receiver |
| 25 | rechargeable battery | 30 | induced coil module |
| 31 | induced reception coil | 32 | transmission cord |
| 40 | speaker | 50 | circular frame |
| 51 | control key | 52 | rib ring |
| 60 | top frame | 61 | net cover |
| 62 | fitting post | 63 | top hole |
| 70 | fixing plate | 71 | upper screw post |
| 80 | base | 81 | magnetic element |

-continued

The elements related to the present invention are listed as follows:

| | | | |
|---|---|---|---|
| 82 | energy to signal converter | 83 | induced transmission coil |
| 211 | screw hole | 212 | MCU chip |
| 213 | wireless signal control chip | | |
| 214 | audio control chip | 215 | sound-effect control chip |
| 216 | power amplifier chip | 221 | sense-activated panel |
| 222 | operation control switch | 511 | planar touch control panel |
| 512 | push button | 611 | net hole |

What is claimed is:

1. A levitated structure of Bluetooth speaker, comprising:

a main frame, which is concaved to form an inner space and is configured at the inner bottom to accommodate a magnetic element;

a control circuit module, which is configured inside the inner space of main frame, and is further comprising a circuit board, a control panel, a signal to energy converter and a Bluetooth signal receiver, wherein the said control panel, signal to energy converter 23 and Bluetooth signal receiver are electronically linked with the circuit board respectively;

an induced coil module, which is configured inside the bottom of main frame and is further assembled with an induced reception coil and a transmission cord, wherein the transmission cord has one end electronically connected with the induced reception coil which wraps around the magnetic element of main frame with its inner most coil, and the other end of transmission cord is linked with signal to energy converter of the control circuit module to have wireless sensing and transmit AC energy signal consequently, and the transmitted AC energy signal inside the signal to energy converter is finally transformed into DC energy format to provide power consumption of circuit board configured onboard control circuit module and power consumption of chips and electronic parts connect with each other;

a speaker, which is configured on circuit board of control circuit module and has an electronic connection with circuit board;

a circular frame, which has a hollow space in the middle and is further assembled with control keys, and the said control keys are mechanically corresponding to the control panel of control circuit module; and a top frame, which is configured at the upper position of the circular frame.

2. A levitated structure of Bluetooth speaker according to claim 1, wherein magnetic configured inside the main frame could be chosen from any one of permanent magnet (ferroxdure), electronic magnet or rare-earth magnet.

3. A levitated structure of Bluetooth speaker according to claim 1, wherein the fixing plate is configured between the circular frame and the top frame, and is formed as a hollow shape in the center position to accommodate speaker and penetrate through both center of circular frame and fixing plate, and the inner rim of circular frame is extended with a round structure of rib ring which is embedded into and fits with the circumference of fixing plate, and the inner side of fixing plate is configured with plural upper screw posts.

4. A levitated structure of Bluetooth speaker according to claim 3, wherein the inner side of top frame is further configured with corresponding fitting posts which matches and are inserted into the plural upper screw posts to provide an assembly with fixing plate.

5. A levitated structure of Bluetooth speaker according to claim 1, wherein the main frame is extended with plural lower screw posts which are corresponding fitting with the screw holes configured on the circuit board.

6. A levitated structure of Bluetooth speaker according to claim 1, wherein the circuit board of control circuit module is electronically connected with a rechargeable battery which is further electronically connected with the signal to energy converter, and the lower position of main frame is extended with a battery rack which accommodates rechargeable battery.

7. A levitated structure of Bluetooth speaker according to claim 1, wherein the main frame is levitated over the base which is configured with a magnetic element at inner top position, and the magnetic element is adopted with a reverse polarity opposite to that of magnetic element configured in main frame, and the magnetic element is chosen from any one of permanent magnet (ferroxdure), electronic magnet or rare-earth magnet.

8. A levitated structure of Bluetooth speaker according to claim 7, wherein there is an energy to signal converter and an induced transmission coil configured inside the base, wherein the energy to signal converter and the induced transmission coil are electronically connected with each other and the inner most coil of induced transmission coil wraps around the outer rim of magnetic element, and the energy to signal converter transforms the energy into AC signal and transmits it to induced reception coil on the induced coil module located at main frame to carry out wireless transmission.

9. A levitated structure of Bluetooth speaker according to claim 1, wherein the external audio signal received by the Bluetooth signal receiver coming from any or at least two devices with Bluetooth function such as a media player, portable devices, DVD stereo, TV and/or vehicle GPS guidance media system.

10. A levitated structure of Bluetooth speaker according to claim 1, wherein control keys are formed as a planar touch control panel which shows the icon to operate.

* * * * *